US006949059B2

(12) United States Patent
Georgiades

(10) Patent No.: US 6,949,059 B2
(45) Date of Patent: Sep. 27, 2005

(54) TWO CYLINDER ONE PIECE PIN STRIPPING DEVICE

(75) Inventor: Gregory Georgiades, Longmeadow, MA (US)

(73) Assignee: Winkler + Dunnebier, AG (DE)

( * ) Notice: Subject to any disclaimer, the term of this patent is extended or adjusted under 35 U.S.C. 154(b) by 8 days.

(21) Appl. No.: 10/251,375

(22) Filed: Sep. 18, 2002

(65) Prior Publication Data

US 2004/0053761 A1 Mar. 18, 2004

(51) Int. Cl.[7] ..... B31B 49/00

(52) U.S. Cl. ..... 493/373; 493/82; 493/83; 493/342; 83/105; 83/145

(58) Field of Search ..... 493/82, 83, 373, 493/64, 342, 370; 83/113, 121, 122, 66, 105, 132, 145

(56) References Cited

U.S. PATENT DOCUMENTS

| | | | | | |
|---|---|---|---|---|---|
| 2,805,857 | A | * | 9/1957 | Policansky | 271/275 |
| 3,270,602 | A | * | 9/1966 | Kirby et al. | 83/102 |
| 3,320,864 | A | * | 5/1967 | Zernov | 493/373 |
| 3,391,589 | A | * | 7/1968 | Bishop | 83/103 |
| 3,643,553 | A | * | 2/1972 | Morimoto | 493/373 |
| 3,651,724 | A | * | 3/1972 | Huffman | 83/24 |
| 4,295,842 | A | * | 10/1981 | Bell | 493/342 |
| 4,305,716 | A | * | 12/1981 | Nickum | 493/342 |
| 4,329,893 | A | * | 5/1982 | Wong | 83/24 |
| 4,561,334 | A | * | 12/1985 | Sarka | 83/27 |
| 4,613,321 | A | * | 9/1986 | Kesten et al. | 493/342 |
| 5,303,623 | A | * | 4/1994 | Chiloff | 83/121 |
| 6,397,714 | B1 | * | 6/2002 | Borel | 83/118 |

* cited by examiner

*Primary Examiner*—Stephen F. Gerrity
*Assistant Examiner*—Thanh Truong
(74) *Attorney, Agent, or Firm*—Shook, Hardy & Bacon, L.L.P.

(57) ABSTRACT

A device used to separate and discard a skeleton formed when a blank is cut into the pattern of a folding carton, envelope, or other desired shape is provided. The device includes first and second separating cylinders. The second separating cylinder includes at least one protrusion extending from the surface thereof, and also has at least one recess formed therein. The protrusions are used to couple the skeleton to the second cylinder. The device further includes a stripping plate having a leading edge positioned near the second cylinder. At least one stripping finger extends from the edge of the stripping plate and within the recess of the second cylinder. The stripping finger is thereby positioned between the second cylinder and the skeleton as the second cylinder rotates toward the stripping finger. The stripping finger operates to disengage the skeleton from the protrusions, thereby stripping the skeleton from the second cylinder.

11 Claims, 2 Drawing Sheets

TWO CYLINDER ONE PIECE PIN STRIPPING DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to a separating device comprising two cylinders and a one piece pin stripping device. In particular, this invention relates to a device having a stripping plate with fingers adapted to extend within a groove formed in the surface of one of the separating cylinders, whereby waste material coupled to one of the cylinders by the one-piece pin during the formation of a folding carton, envelope or other pattern from a blank can be stripped from the cylinder.

In manufacturing folding cartons, envelopes or other similar items from a blank, a waste product or skeleton is typically produced. Generally, the blank is first cut into the pattern of the folding carton, envelope or other desired pattern using a die or other type of cutting device. After the pattern is cut, a skeleton remains surrounding the pattern or within the pattern if a window portion is incorporated into the folding carton. To separate the skeleton from the pattern using the devices of the prior art, both the skeleton and pattern are fed into a separating mechanism. The separating mechanism typically includes an upper and a lower cylinder, with the lower cylinder having a plurality of pins extending therefrom. As the skeleton is fed between the cylinders, the pins are arranged to penetrate and thereby couple the skeleton to the lower cylinder, while the pattern advances through the manufacturing process. The skeleton is then removed from the lower cylinder using a stripping plate. In particular, the stripping plate of the prior art is positioned adjacent the surface of the lower cylinder, leaving a narrow gap between the stripping plate and the lower cylinder. As the lower cylinder rotates with the skeleton coupled thereon, the leading edge of the stripping plate is oriented to catch the edge of the skeleton and thereby strip the skeleton from the pins as the cylinder continues to rotate.

This prior art stripping device suffers from a number of drawbacks and deficiencies. For instance, the skeleton frequently gets jammed in between the stripping plate and cylinder due to the failure of the stripping plate to effectively remove the skeleton from the all of the pins. At times during the separating process, one or more portions of the skeleton may be curled and positioned relatively close to the lower cylinder as it approaches the stripping plate, such that the stripping plate is not always positioned to catch the leading edges of all of the portions of the skeleton. Therefore, the stripping plate may strip some portions of the skeleton, while other portions remain coupled to the lower cylinder. This non-uniform stripping of the skeleton can cause it to jam between the stripping plate and lower cylinder. Jammed skeletons can cause the manufacturing process to shut down until the problem is corrected. Further, with the prior art devices, when portions of the skeletons remain coupled with the cylinder, multiple skeletons can accumulate on the lower cylinder, eventually reducing the effectiveness of the pin stripping method. Accordingly, such unwanted build-up of skeletons can also force the manufacturing process to be suspended while the waste products are removed. Thus, the use of the prior art stripping plates often results in delays in manufacturing and resultant increases in production costs.

Accordingly, there remains a need for a device that will effectively and completely strip a paper waste product from a two cylinder, one-piece pin assembly without the waste product becoming jammed between the separating cylinder and stripping plate. The present invention fills these needs as well as various other needs.

BRIEF SUMMARY OF THE INVENTION

In order to overcome the above-stated problems and limitations, and to achieve the noted objects, there is provided a device that is used to discard a skeleton formed when a folding carton, envelope or other type of pattern is cut from a blank.

In general, the device includes first and second separating cylinders. The second separating cylinder has at least one and typically a plurality of protrusions extending from its surface, and at least one recess formed in the surface thereof. The protrusions are used to pierce and thereby couple the skeleton to the second separating cylinder. The device further includes a stripping plate having a leading edge positioned near the second separating cylinder. At least one stripping finger extends from the edge of the stripping plate and is positioned to correspond with and fit essentially within the recess of the second separating cylinder. As the second separating cylinder advances the skeleton toward the stripping plate, the stripping finger is positioned between the second separating cylinder and the skeleton to catch an edge of the skeleton and remove or strip it from the protrusions on the second separating cylinder.

Additionally, the stripping plate may include at least one slot formed in the leading edge, which slot is aligned to fit around a corresponding protrusion extending from the second cylinder, allowing the plate to pass over the protrusions without coming into contact with the same.

Further objects, features, and advantages of the present invention over the prior art will become apparent from the detailed description of the drawings which follow, when considered with the attached figures.

BRIEF DESCRIPTION OF THE SEVERAL VIEWS OF THE DRAWINGS

In the accompanying drawings which form a part of the specification and are to be read in conjunction therewith and in which like reference numerals are employed to indicate like parts in the various views.

DETAILED DESCRIPTION OF THE INVENTION

Figure 1:
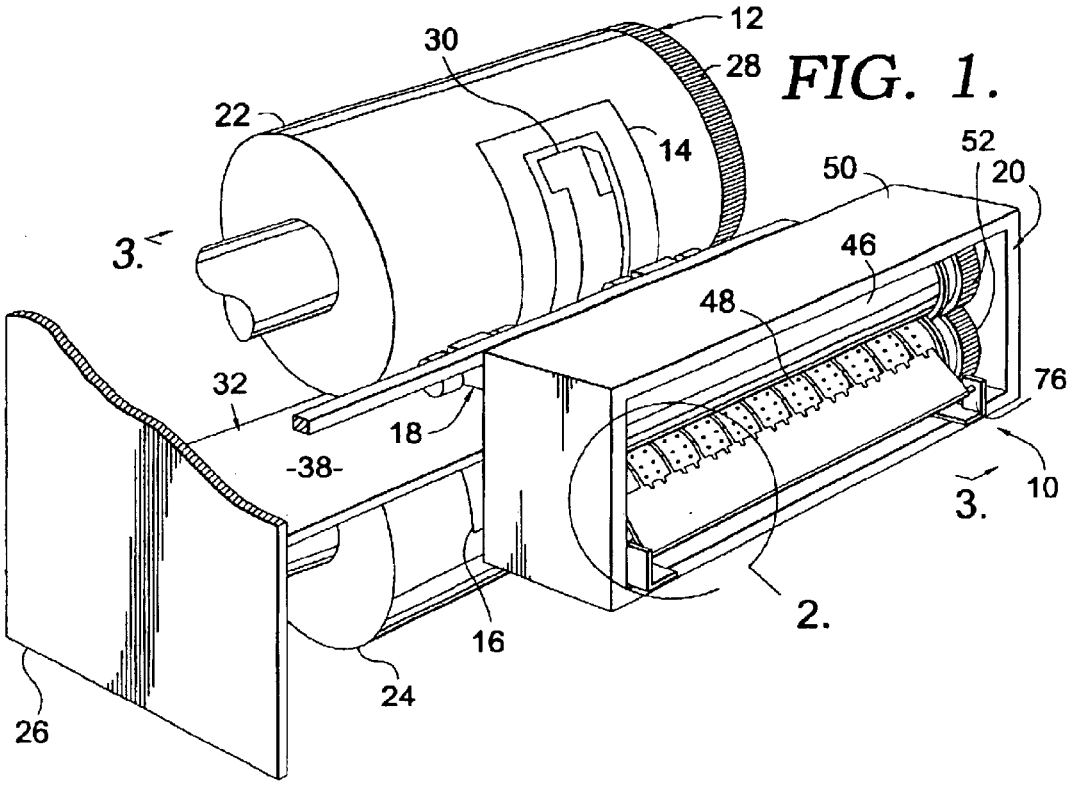
FIG. 1 is a perspective view having portions broken away to show a cutting mechanism, and a separating mechanism and a stripping device according to the present invention.

Referring now to the drawings in detail, and initially to FIG. 1, numeral 10 generally designates a stripping device constructed in accordance with a first preferred embodiment of the present invention. A blank or web is typically fed into a cutting mechanism 12 where a male and female die 14, 16 cut the blank in the shape of a folding carton, envelope, or other desired pattern. When the desired pattern is formed, a skeleton or waste portion surrounding the pattern remains. In some cases, a portion of the skeleton may also be located within the periphery of the pattern, for example, if a window portion is to be included in the pattern. An intermediate guide roller assembly 18 is used to maintain the position of the pattern and skeleton relative to one another as they advance from the cutting mechanism 12 to a separating mechanism 20. Separating mechanism 20 then separates the skeleton from the pattern by coupling the skeleton to a part of separating mechanism 20, after which it is removed by stripping device 10.

Figure 2:
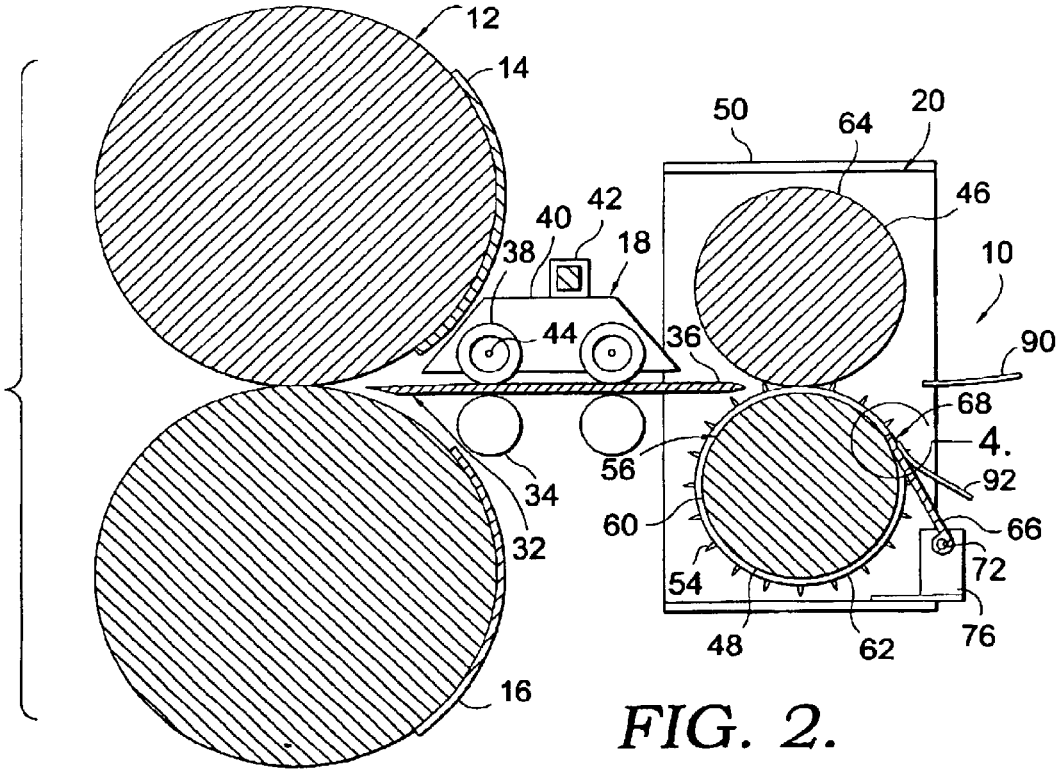
FIG. 2 is an enlarged cross-sectional view taken along line 2—2 of FIG. 1 showing the cutting mechanism, the separating mechanism and the stripping device.

As best seen in FIGS. 1 and 2, cutting mechanism 12 includes top and bottom rolls 22, 24 that are rotatably mounted to a main housing 26, which remains stationary throughout the manufacturing process. Top and bottom rolls 22, 24 are disposed in a manner which allows them to rotate with respect to each other, and are separated from one another at a distance which allows the blank or web to pass therebetween while being cut by the dies 14, 16, as will be discussed below. In one embodiment, rolls 22, 24 include a plurality of splines 28 radially disposed about one circumferential edge of each roll, whereby the splines 28 of each roll 22, 24 engage each other and thereby rotate the rolls 22, 24 with respect to each other. However, the manner by which the top and bottom rolls 22,24 rotate can be any suitable method for rotation. Typically, rolls 22, 24 are formed of a magnetic material for coupling male and female dies 14, 16, respectively, thereto. It will be understood and appreciated that any suitable mechanical fasteners, adhesives or the like may alternatively be used to couple dies 14, 16 to rolls 22, 24.

Dies 14, 16 are generally used to cut the blank or web into the pattern or shape of the folding carton, envelope, or other desired product. In particular, male die 14 includes a raised peripheral portion 30 arranged in the shape of the desired pattern. Female die 16 has a corresponding raised portion which extends from its surface and includes a medial channel therewithin, which medial channel is adapted to receive raised portion 30 when the two dies 14, 16 converge to cut the blank. In use, when the blank passes between dies 14, 16, the desired pattern is cut into the blank as the peripheral portion 30 of die 14 is received in the corresponding medial channel of die 16.

Positioned between the cutting mechanism 12 and the separating mechanism 20 are an intermediate guide roll assembly 18 and a support plate 32 which are adapted to support the pattern and skeleton as they advance therebetween. Support plate 32 is mounted to housing 26 above a pair of supports 34. Typically, two intermediate guide roller assemblies 18 are used, although it will be understood that the number of guide roller assemblies may vary depending on the width of the blank used in the manufacturing process and other considerations. As best seen in FIG. 2, each intermediate guide roller assembly 18 includes a set of guide rollers 38, a carriage 40 and an intermediate mounting member 42 positioned on top of carriage 40, by which assembly 18 is mounted to housing 26. Carriage 40 further includes a pair of axles 44 on which guide rollers 38 are mounted. Intermediate guide roller assembly 18 and support plate 32 are positioned to contact or be slightly spaced from each other, permitting the pattern and skeleton to pass securely therebetween without separating as they advance from the cutting mechanism 12 to the separating mechanism 20.

As best seen in FIGS. 1 and 2, separating mechanism 20 includes top and bottom separating cylinders 46, 48 rotatably mounted to a secondary housing 50, which remains stationary throughout the manufacturing process. Top and bottom cylinders 46, 48 are separated from one another at a distance that will allow the pattern and skeleton to pass therebetween as they advance from intermediate guide roller assembly 18. Cylinders 46,48 are further disposed in a manner which allows them to rotate with respect to each other. In one embodiment, cylinders 46, 48 include a plurality of splines 52 radially disposed about one circumferential edge of each cylinder, whereby the splines 52 of each cylinder 46,48 engage each other and allow the cylinders 46,48 to rotate with respect to each other. It is understood that any suitable means for causing cylinders 46, 48 to rotate would be within the scope of this invention.

Bottom separating cylinder 48 has at least one and generally a plurality of protrusions extending from the surface thereof for coupling the skeleton thereto, as will be discussed in detail below. In one embodiment, at least one and generally a plurality of apertures are formed in the surface of cylinder 48, wherein each aperture is adapted to receive a corresponding protrusion therethrough. The protrusions can be individual pins 54 which are adapted to be removably mounted within a corresponding aperture by screwing pin 54 into the aperture. Pins 54 are selectively positioned on bottom cylinder 48 so as to pierce the skeleton as the pattern and skeleton are fed between top and bottom cylinders 46, 48. It will be understood and appreciated that the selective positioning of pins 54 may be altered by disengaging the pin from its corresponding aperture, and subsequently remounting each pin 54 in a desired aperture. Positioning of the pins 54 depends on, among other factors, the size, shape and location of the skeleton produced by the cutting mechanism 12. It is further to be understood that, in addition to screwing the pins into the apertures, any suitable method of affixing the pins onto the cylinder can be used and is considered to be within the scope of this invention.

Figure 3:
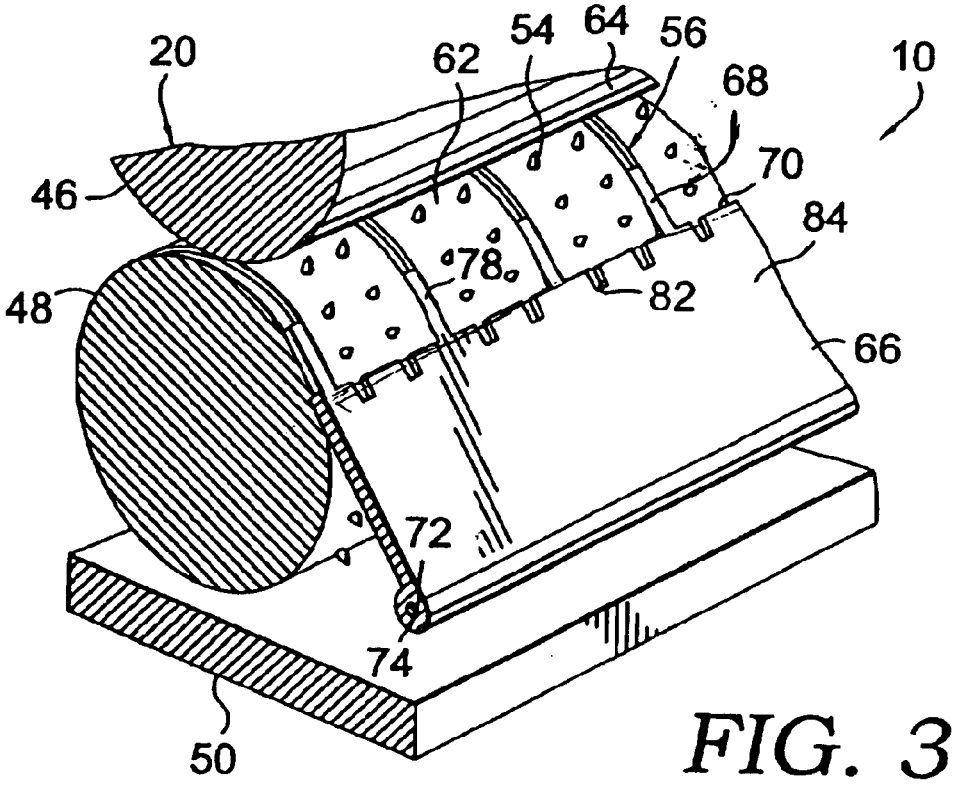
FIG. 3 is an enlarged fragmentary perspective view of the stripping device detailing a plurality of stripping fingers extending within a plurality of corresponding grooves formed in a portion of the separating mechanism.
Figure 4:
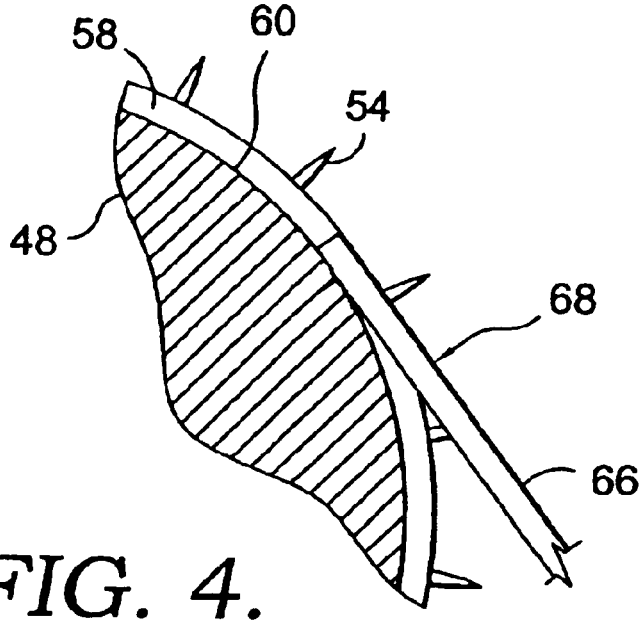
FIG. 4 is an enlarged fragmentary cross-sectional view of one of the stripping fingers positioned within a corresponding one of the grooves on a bottom separating cylinder.

As best seen in FIGS. 3 and 4, bottom separating cylinder 48 also includes one or more grooves or channels 56 formed in the outer surface 62 thereof, which grooves 56 extend circumferentially therearound. These grooves 56 are adapted to receive a portion of stripping device 10, as will be described in more detail below. Grooves 56 have a generally U-shaped cross-section having two sidewalls 58 and a lower surface 60. In particular, sidewalls 58 extend into an outer surface 62 of bottom cylinder 48 and lower surface 60 extends therebetween. It should be understood that grooves having other cross-sectional shapes such as, but not limited to, semi-circle or V-shape are also within the scope of the present invention.

Top separating cylinder 46 has a generally smooth surface 64. However, it should be understood that surface 64 may preferably include apertures formed therein which are positioned and adapted to receive at least the tips of pins 54 as the pattern and skeleton are fed between top and bottom separating cylinders 46, 48. These apertures in surface 64 assist pins 54 in piercing the skeleton.

As best seen in FIGS. 1 and 2, stripping device 10 is mounted to secondary housing 50 and is adapted to strip the skeleton from bottom cylinder 48 of separating mechanism 20. Referring to FIGS. 3 and 4, device 10 includes a stripping plate 66 having at least one, and preferably a plurality of stripping fingers 68 extending from a leading edge 70 thereof. Stripping plate 66 can be mounted to secondary housing 50 in any suitable manner. In one embodiment, stripping plate 66 includes a channel or bore 72 extending through the length of a distal edge thereof, and a rod 74 is positioned within the channel 72 to pass therethrough and protrude partially from each end of stripping plate 66 as shown in FIG. 1. Each end of rod 74 is adapted to be received by a mounting bracket 76 coupled with secondary housing 50.

As best seen in FIG. 4, each stripping finger 68 is adapted to be received within a corresponding groove 56. As will be appreciated, stripping plate 66 and bottom cylinder 48 should be positioned so that stripping fingers 68 can extend in to grooves 56. Further, stripping fingers 68 and grooves 56 should be appropriately sized and shaped so that when stripping fingers 68 are positioned within the grooves 56, they do not extend any higher than the outer surface 62 of the cylinder 48. In this manner, stripping fingers 68 can be positioned between bottom cylinder 48 and the skeleton as the skeleton advances toward the stripping device 10. Stripping plate 66 also preferably includes a number of notches 82 formed in leading edge 70 to allow pins 54 to pass by without coming into contact or interfering with stripping plate 66.

In operation, a web or blank is first fed through and cut by cutting mechanism 12.

Specifically, bottom roll 24 is rotated in a clockwise direction by a main drive gear, not shown, which is in turn rotated by a power source. As bottom roll is rotated, the splines 28 on top and bottom rolls 22, 24 engage each other, and top roll 22 is thereby rotated in a counterclockwise direction. The rotation of top and bottom rolls 22, 24 operates to feed the web or blank therebetween, and as the dies 14, 16 come into contact with each other, the blank is cut by the action of raised peripheral portion 30 and the corresponding medial channel of die 16, thereby forming the desired pattern and the skeleton or waste product. As stated above, the skeleton may surround the pattern, or may also be located within the pattern if a window portion is to be formed in the pattern. It is understood that in certain circumstances, the skeleton may be located solely within the pattern.

The support plate 32 and the intermediate guide roller assembly 18 hold the pattern and skeleton together as they advance between cutting mechanism 12 and the separating mechanism 20. In particular, the pattern and skeleton are contacted on an upper side by guide rollers 38, and on a bottom side by support plate 32. As the pattern and skeleton advance, guide rollers 38 rotate about axles 44 allowing the pattern and skeleton to remain firmly positioned against support plate 32, while preventing the pattern and skeleton from separating prior to reaching the separating mechanism 20.

The pattern and skeleton then are fed into separating mechanism 20. Bottom separating cylinder 48 may be rotated in a clockwise direction by the same main drive gear that rotates the top and bottom rolls 22, 24 in cutting mechanism 12. Splines 52 on top and bottom separating cylinders 46, 48 engage each another, and top cylinder 46 is thereby rotated in a counterclockwise direction. The rotation of top and bottom separating cylinders 46, 48 operates to advance the pattern and skeleton thereberween. Pins 54 then pierce the skeleton, coupling the skeleton to bottom separating cylinder 48. At this point, the pattern 90 and skeleton 92 separate from each other, as the pattern 90 continues to advance through the manufacturing process, while bottom separating cylinder 48 advances the skeleton 92 toward stripping plate 66.

As described above, each stripping finger 68 is positioned within a corresponding groove 56 while bottom separating cylinder 48 rotates to thereby advance the skeleton toward stripping plate 66. As the skeleton 92 approaches edge 70 of stripping plate 66, stripping fingers 68 extending within grooves 56 become positioned between bottom separating cylinder 48 and the skeleton. As the skeleton 92 continues to advance, it proceeds to slide on a top surface 84 of stripping plate 66 thereby extricating the skeleton from pins 54. Notches 82 allow pins 54 to pass by stripping plate 66 as the skeleton 92 is being removed from bottom separating cylinder 48. Once the skeleton is 92 completely disengaged from pins 54, it advances along top surface 84 of stripping plate 66 and into a waste area.

It can, therefore, be seen that the invention is one that is designed to overcome the drawbacks and deficiencies existing in the prior art. The invention is a stripping device that includes one or more stripping fingers which extend within a corresponding set of grooves formed in a separating-cylinder. The stripping fingers positioned within the grooves so that the skeleton may be stripped from the separating cylinder without jamming between the stripping plate and the separating cylinder. This novel system for removing the waste product from a pattern without jamming the manufacturing line or otherwise causing unwanted delays and additional steps, decreases manufacturing times as well as manufacturing costs associated with the prior art waste removal devices.

While particular embodiments of the invention have been shown, it will be understood, of course, that the invention is not limited thereto, since modifications may be made by those skilled in the art, particularly in light of the foregoing teachings. Reasonable variation and modification are possible within the scope of the foregoing disclosure of the invention without departing from the spirit of the invention.

What is claimed is:

1. A device for stripping a waste material from an article cut from one of a blank and a web, comprising:

first and second separating cylinders, said cylinders defining a space therebetween which receives said cut article, wherein at least one protrusion extends from a surface of said second cylinder to couple the waste material to said second cylinder, and wherein said second cylinder has at least one substantially continuous groove formed therein;

means for guiding said article into said space defined between said first and second cylinders;

a stripping plate having an upper surface and a leading edge positioned in close proximity to said second cylinder, said stripping plate extending substantially the length of said second cylinder; and at least one stripping finger extending from said leading edge of said stripping plate, wherein at least a portion of said stripping finger extends within said at least one continuous groove formed in said second cylinder, said stripping finger being positioned in said space between said second cylinder and waste material as said second cylinder rotates toward said stripping finger so that the waste material is removed from said at least one protrusions and stripped from said second cylinder onto said upper surface of said plate, and wherein said leading edge of said stripping plate is in close proximity to said surface of said second cylinder and includes at least one recess positioned adjacent to said at least one finger for accommodating said at least one protrusion.

2. The device of claim 1, wherein said stripping finger includes top and bottom surfaces, wherein at least a portion of said top surface is positioned within said continuous groove of said second cylinder.

3. The device of claim 1, wherein each protrusion is a pin.

4. A device for discarding a skeleton produced when a cutting mechanism forms a folding carton or other type of envelope pattern from an article comprising one of a blank and a web, said device comprising:

a housing;

a first separating cylinder rotatably mounted relative to said housing;

a second separating cylinder having an outer surface and being rotatably mounted relative to said housing, said second separating cylinder positioned at a distance from said first separating cylinder to allow the article to fit therebetween;

guiding means for accepting said article after said article has been cut, then guiding said article between said first and second cylinders;

said second separating cylinder having a plurality of substantially continuous grooves formed in said outer surface;

a plurality of protrusions extending from said outer surface of said second separating cylinder; and a stripping plate coupled with said housing, said stripping plate having an upper surface and an edge with a plurality of stripping fingers extending therefrom, each of said stripping fingers being positioned within said one of said substantially continuous grooves said stripping plate extending substantially the length of said second cylinder and said edge being substantially straight and in close proximity to said outer surface of said second cylinder, and having a plurality of notches, each of said notches being adapted to permit the passage of one said plurality of protrusions, wherein said plurality of protrusions penetrates the skeleton to separate the skeleton from the folding carton pattern, and wherein said plurality of stripping fingers is positioned between said second separating cylinder and the folding carton pattern to remove the skeleton from said protrusions onto said upper surface of said plate.

5. The device of claim 4, wherein each of said stripping fingers includes top and bottom surfaces, wherein at least a portion of said top surface is positioned below the outer surface of said second separating cylinder.

6. The device of claim 4, wherein each of said protrusions is a one-piece pin.

7. A device for separating and stripping waste material from an article comprising one of a web or a blank during an envelope or carton manufacturing process, and said device comprising:

a guiding mechanism which receives said article after it has been cut, and then feeds said article into a separating mechanism including first and second separating cylinders, wherein a plurality of protrusions extends from an outer surface of said second cylinder to pierce the waste material and thus couple the waste material to said second cylinder, and wherein said second cylinder has a plurality of substantially continuous grooves formed therein, a stripping plate having an upper surface and a leading edge positioned in close proximity to said second cylinder, said stripping plate extending substantially the length of said second cylinder; and a plurality of stripping fingers extending from said leading edge of said stripping plate said leading edge being in close proximity to a surface of said second cylinder, said leading edge further comprising a plurality of recesses, each of said recesses adapted to accommodate the passage of one of said protrusions, wherein at least a portion of each of said stripping fingers is positioned to extend within a corresponding one of said grooves formed in said second cylinder, said stripping fingers each being adapted to be positioned between said second cylinder and the waste material as said second cylinder rotates toward said stripping fingers to forcibly unstick the waste material from said protrusions and strip said waste material from said second cylinder onto said upper surface of said plate so that said waste material can be discarded.

8. The device of claim 7, wherein each of said grooves extends around the circumference of said second cylinder.

9. The device of claim 7, wherein said stripping fingers includes top and bottom surfaces, wherein at least a portion of said top surface is positioned within one of said grooves in said second cylinder.

10. The device of claim 7, wherein said protrusions are one-piece pins.

11. A method for discarding a skeleton formed from cutting a folding carton pattern from an article, said article comprising one of a web and a blank, said method comprising:

providing a separating mechanism having first and second cylinders, said second cylinder having an outer surface with a plurality of grooves formed therein;

moving the pattern and skeleton to said separating mechanism using a guide means which accepts said pattern and said skeleton after they have been cut and guides said pattern and said skeleton in between said first and second cylinders for stripping;

providing a stripping plate having an upper surface and an edge with a plurality of stripping fingers extending therefrom, said stripping plate extending substantially the length of said second cylinder and having a leading edge which is in close proximity to said outer surface of said second cylinder;

positioning each of said stripping fingers within one of said grooves;

rotating said first and second separating cylinders to feed the pattern and skeleton between said first and second cylinders;

using a plurality of pins to skewer and thus couple the waste material to said second cylinder to separate the waste material from the folding carton pattern which remains on said first cylinder;

notching said leading edge of said plate, said notches adapted to allow the passage of said pins when said leading edge is proximate said outer surface of said second cylinder; and further rotating said first and second separating cylinders so that said stripping fingers are positioned between said second cylinder and the skeleton whereby said stripping fingers removes the waste material from said pins on said second cylinder onto said upper surface of said plate.

* * * * *